US006792220B2

(12) United States Patent
Randall et al.

(10) Patent No.: US 6,792,220 B2
(45) Date of Patent: Sep. 14, 2004

(54) DUAL DENSITY GRAY PATCH TONER CONTROL

(75) Inventors: Stephen F. Randall, Eden, NY (US); Song-feng Mo, Webster, NY (US); Wendy K. Apton, Rochester, NY (US); David C. Craig, Pittsford, NY (US); Patricio G. Medina, Rochester, NY (US); Patrick J. Walker, Henrietta, NY (US); Ralph A. Shoemaker, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,390

(22) Filed: Jan. 15, 2003

(65) Prior Publication Data

US 2004/0136737 A1 Jul. 15, 2004

(51) Int. Cl.[7] ..... G03G 15/00
(52) U.S. Cl. ..... 399/49; 399/44; 399/53
(58) Field of Search ..... 399/49, 44, 53, 399/46

(56) References Cited

U.S. PATENT DOCUMENTS 5,895,141 A * 4/1999 Budnik et al. ..... 399/58
6,006,047 A * 12/1999 Mara et al. ..... 399/49
6,029,021 A * 2/2000 Nishimura et al. ..... 399/49
6,035,152 A * 3/2000 Craig et al. ..... 399/49

* cited by examiner

*Primary Examiner*—Quana Grainger
(74) *Attorney, Agent, or Firm*—Oliff & Berridge, PLC

(57) ABSTRACT

A method and apparatus are provided to calibrate a xerographic print engine toner concentration sensor to accurately control the toner concentration to a specified operating target. At least two control patches are imaged onto a photoreceptor. Each patch has a different voltage level where the voltage levels are the difference between the exposure discharge voltage and the developmental roll voltage. The relative reflectivity of each patches is obtained. The latent patches are repeatedly developed at different toner concentrations. The reflectivities of the patches formed at the same toner concentration are combined to obtain a combined reflectivity for that toner concentration. As a result, a toner concentration curve is obtained that has an improved response relative to the toner concentration curves that correspond to each of the individual voltage levels.

8 Claims, 5 Drawing Sheets

DUAL DENSITY GRAY PATCH TONER CONTROL

BACKGROUND OF THE INVENTION

1. Field of Invention

This invention relates generally to a toner concentration sensor usable in an electrophotographic printing machine.

2. Description of Related Art

U.S. Pat. No. 6,006,047, the subject matter of which is incorporated herein by reference in its entirety, discloses an apparatus that monitors and controls an electrical parameter of an imaging surface. The monitor controlling apparatus includes a patch generator that records on the imaging surface a first control patch at a first voltage level and a second control patch at a second voltage level. This apparatus also includes an electrostatic volt meter that measures voltage potentials associated with the first and second control patches. A processor, in communication with the patch generator, calculates electrical parameters of the imaging surface from the measured voltage potentials from the first and second control packages. The processor determines a deviation between the calculated electrical parameter values and setup values.

The processor then produces and sends a feedback error signal to the patch generator if the deviation exceeds a threshold level. The patch generator then records a third control patch at a third voltage level on the imaging surface in response to receiving the error signal. The electrostatic volt meter senses the third control patch. The processor calculates the electrical parameters of the imaging surface from the measured voltage potential of the third control patch and determines a correction factor. The charging device, exposure system and developer are adjusted based on this correction factor. The three patch sequence is repeated until convergence on a desired value is achieved.

U.S. Pat. No. 5,895,141, the subject matter of which is incorporated herein by reference in its entirety, discloses a toner concentration control system which determines when the charge between the developer material particles, that is, the developer particles and the carrier particles, becomes weak. This results in initial copies which are darker than expected. To determine when this condition has occurred, this system develops two halftone calibration patches which are intended to have reflectivities of 12% and 87%, i.e., one patch reflects approximately 12% of the light incident thereon and the other patch reflects approximately 87% of the light incident thereon. The actual reflectance of these two patches is read by a black toner area coverage sensor and recorded. The measured reflectance difference between the two patches, such as, for example, 75% (12% minus 87%), is calculated. A large difference is a good indicator of whether the patches have become too dark. If the reflectance difference (delta) is less than a target value, the tribo is considered to be within an acceptable range and nothing is done. Tribo is shorthand nomenclature for the tribo-electric relationship between toner carrier particles and toner particles, i.e., wherein the toner particles have a polarity causing them to detach themselves from the carrier particles in charged portions of the image-bearing articles and be attracted to a photoconductive surface. If, however, the difference is greater than the target value, the print engine proceeds to perform a special rest recovery setup. The setup initially tones up and tones down the system enough to increase the toner triboelectric charge and rejuvenate the toner material. The system then continues with the regular setup steps of toner concentration setup and electrostatic convergence. Once completed, the system goes back online and is ready to produce good copy quality. The system disclosed in the 141 patent allows a toner concentration sensor to be eliminated.

U.S. Pat. No. 6,029,021, the subject matter of which is incorporated herein by reference in its entirety, discloses an image forming system having a dual component inversion developing system that forms a toner patch image. The toner patch image is used to determine the toner concentration and to control an image forming condition such as the toner concentration based on the density of the toner patch image. Two patches, a relatively small point patch image and another toner patch image, a band patch image, are formed on the image carrier. A concentration sensor detects light reflected from each of the point patch image and the band patch image. For each patch, an average value of the read detection values read by the concentration sensor is calculated. For each patch, a patch image concentration is calculated based on the average value detected for each patch and on the ratio between the average value and the detection value on a clean face of the photoreceptor.

Charge potential control, based on the point patch image concentration, that is; control of the toner concentration; is executed before executing a xerographic job, that is, during an interimaging interval. Toner concentration control based on the band patch image concentration is executed, for example, after the first job after the image forming system is powered on, or after outputting a predetermined number of sheets, such as, for example, 20 sheets, from after a previous concentration control event.

U.S. Pat. No. 6,035,152, the subject matter of which is incorporated herein by reference in its entirety, discloses a xerographic print engine that has process control systems and methods that adjust printing operations based on a tone reproduction curve which is setup based on test control patches.

SUMMARY OF THE INVENTION

As discussed above, toner concentration control typically involves creating a single toner patch on a single charged area of a photoreceptor. Even when multiple patches are formed, a single charge level is placed on the photoreceptor. However, the inventors have determined that the toner concentration curve between the toner concentration and the relative reflectivity is highly dependent on the charge level placed on the photoreceptor.

This invention provides systems and methods for determining an improved calibration curve for a toner concentration sensor.

This invention separately provides systems and methods for determining a plurality of calibration curves for a toner concentration sensor having different photoreceptor charge levels.

This invention further provides systems and methods for combining the plurality of calibration curves for the toner concentration sensor to form a composite calibration curve.

This invention additionally provides systems and methods that determine an average calibration curve from the plurality of calibration curves.

This invention separately provides systems and methods for charging a photoreceptor to different charge levels when determining different calibration curves for a toner concentration sensor.

This invention separately provides systems and methods that determine a plurality of calibration curves for a toner concentration sensor where each calibration curve is responsive over a distinct toner concentration range.

This invention additionally provides systems and methods that determine each of the calibration curves that are responsive over a distinct toner concentration range using a distinct charge level on the photoreceptor.

The systems and methods according to this invention concern xerographic print engines that employ a toner concentration sensor. In various exemplary embodiments, the systems and methods according to this invention prepare a toner concentration calibration curve by developing toner concentration patches with different toner concentrations and calibrate a toner concentration sensor to actual system development response by operating the toner concentration sensor at two or more different operating points. In various exemplary embodiments, for example, the two different operating points are two extreme development voltage levels where the toner concentration sensor provides most sensitive data.

In various exemplary embodiments, the systems and methods according to this invention use the print engine light source, which is already in the print engine, to generate continuous tone 100% area coverage patches at two different operating points for the calibration. In various exemplary embodiments, the patches are developed multiple times using developer which has varying amounts of toner, i.e., using different toner concentrations. In various exemplary embodiments, the relative reflectivities of the different patches developed using different amounts of toner are graphed with respect to the toner concentrations to obtain a number of distinct toner concentration sensitivity curves. In various exemplary embodiments of the systems and methods according to this invention, an average toner concentration curve is determined based on the number of distinct toner concentration sensitivity curves. By calibrating the toner concentration sensor according to the invention, greater component latitude and the ability to maintain high image quality for high end printing systems for a longer time can be obtained.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
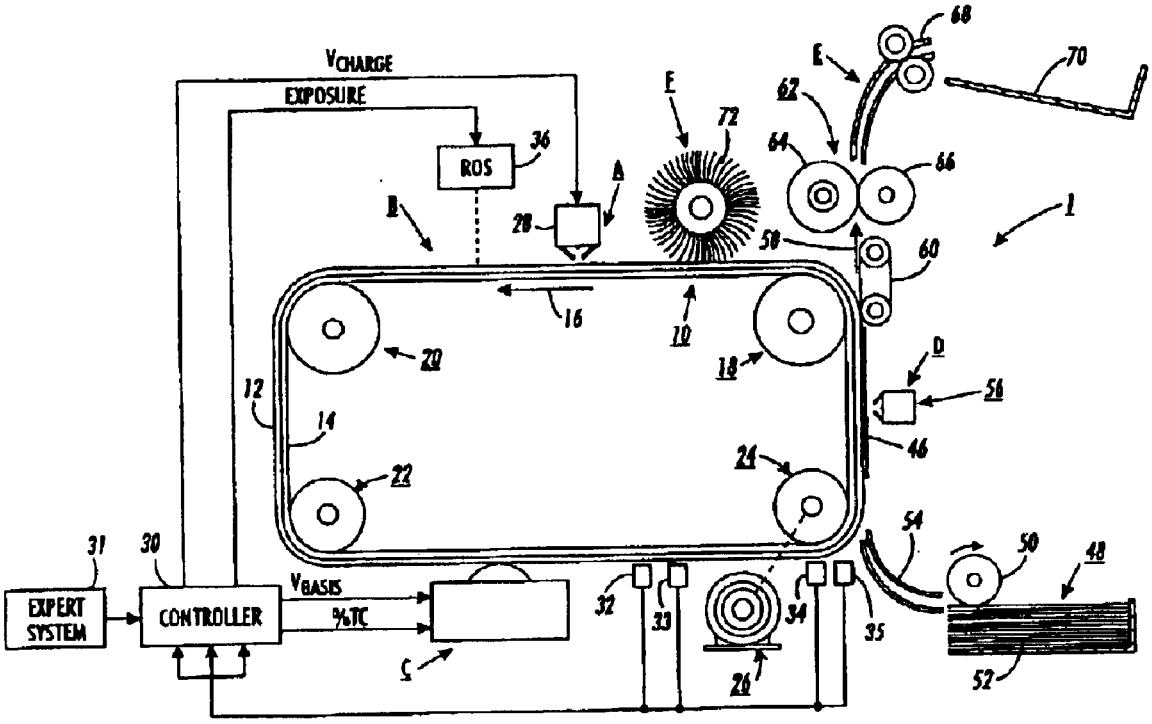
FIG. 1 illustrates a typical electronic imaging system incorporating one exemplary embodiment of a toner concentration sensor control system according to this invention.

FIG. 1 shows the basic elements of the well known system by which an electrophotographic printing machine 1, electrophotographic printer or laser printer 1 uses digital image data to create a dry toner image on plain paper. As shown in FIG. 1, the electrophotographic printing machine 1 includes a photoreceptor 10, which may be in the form of a belt or drum, and which has a charge retentive surface 14.

In FIG. 1, the electrophotographic printing machine 1 employs a belt 10 having a photoconductive surface 12 deposited on a conductive substrate 14. By way of example, the photoconductive surface 12 may be made from a selenium alloy. The conductive substrate 14 is made from an aluminum alloy which is electrically grounded. Other suitable photoconductive surfaces and conductive substrates may also be employed. The belt 10 moves in the direction of an arrow 16 to advance successive portions of the photoconductive surface 12 through the various processing stations disposed about the path of movement of the belt 10. As shown in FIG. 1, the belt 10 is entrained about a number of rollers 18, 20, 22, 24. The roller 24 is coupled to a motor 26, which drives the roller 24 to advance the belt 10 in the direction of the arrow 16. The rollers 18, 20, and 22 are idler rollers which rotate freely as the belt 10 moves in the direction of the arrow 16.

Initially, a portion of the belt 10 passes through a charging station A. At the charging station A, a corona generating device 28 charges a portion of the photoconductive surface 12 of the belt 10 to a relatively high, substantially uniform potential.

Next, the charged portion of the photoconductive surface 12 is advanced through an exposure station B. At the exposure station B, a raster output scanner (ROS) 36 is used to expose the charged portion of photoconductive surface 12 to record an electrostatic latent image on the charged portion of the photoconductive surface 12. In a photocopier or digital photocopier, an input imaging system or a raster input scanner is used to obtain an image to be formed on the photoconductive surface 12. For an analog photocopier, any known or later developed input imaging system can be used to project a light image of an input document or object onto the photoconductive surface. For a digital photocopier, a raster input scanner (RIS) or any suitable known or later developed device can be used to capture an electronic image of the input document or object.

In various exemplary embodiments the raster input scanner can contain document illumination lamps, optics, a mechanical scanning mechanism and photosensing elements, such as charged couple device (CCD) arrays. The raster input scanner captures the entire image from the original document and coverts it to a series of raster scan lines. The raster scan lines,are transmitted from the raster input scanner to the raster output scanner 36.

In a laser printer or digital copier, the raster output scanner 36 illuminates the charged portion of photoconductive surface 12 to selectively discharge the charge on the illuminated portion of the charged photoconductive surface 12. In various exemplary embodiments, the raster output scanner 36 includes lasers with rotating polygon mirror blocks, solid state modulator bars and mirrors. Thereafter, the belt 10 advances the electrostatic latent image recorded on the photoconductive surface 12 to a development station C.

In an analog photocopier, a light lens system is typically used. An original document may be positioned face down upon a transparent platen. Lamps flash light rays onto the original document. The light rays reflected from original document are transmitted through a lens forming a light image onto the conductive surface 12. The lens focuses the light image onto the charged portion of the photoconductive surface 12 to selectively dissipate the charge on the conductive surface 12. This records an electrostatic latent image onto the photoconductive surface 12 that corresponds to the informational areas contained within the original document disposed upon the transparent platen.

Regardless of how the latent image is formed on the photoconductive surface 12, at the development station C, the latent image is developed into a toner image by applying toner particles to the portion of the photoconductive surface 12 carrying the latent image. It should be appreciated that any known or later developed type of developing system can be used in the development station C.

After developing the latent image into the toner image the belt 10 advances the toner image to a transfer station D. At the transfer station D, a sheet of support material 46 is moved into contact with the toner image. The sheet of support material 46 is advanced to the transfer station D by a sheet feeding apparatus 48. In various exemplary embodiments, the sheet feeding apparatus 48 includes a feedroll 50 contacting the uppermost sheet of a stack of sheets 52. The feed roll 50 rotates to advance the uppermost sheet from the stack 52 into a sheet chute 54. The sheet chute 54 directs the advancing sheet of the support material 46 into a contact with the photoconductive surface 12 of the belt 10 in a timed sequence so that the toner image developed on the photoconductive surface 12 contacts the advancing sheet of the support material 46 at the transfer station D.

In various exemplary embodiments, the transfer station D includes a corona generating device 56 that sprays ions onto the backside of the sheet of the support material 46. This attracts the toner image from photoconductive surface 12 to the sheet of the support material 46. After transfer, the sheet of the support material 46 continues to move in the direction of an arrow 58 onto a conveyor 60, which moves the sheet of the support material 46 to a fusing station E.

In various exemplary embodiments, the fusing station E includes a fuser assembly 62, which permanently affixes the toner image to the sheet of the support material 46. In various exemplary embodiments, the fuser assembly 62 includes a heated fuser roller 64 driven by a motor and a backup roller 66. The sheet of the support material 46 passes between the fuser roller 64 and the backup roller 66, with the toner image contacting the fuser roll 64. In this manner, the toner image is permanently affixed to the sheet of the support material 46. After fusing, a chute 68 guides the advancing sheet of the support material 46 to a catch tray 70 for subsequent removal from the printing machine 1 by the operator.

After the sheet of the support material 46 is separated from the photoconductive surface 12 of the belt 10, some residual particles continue to adhere to the photoconductive surface 12. These residual particles are removed from the photoconductive surface 12 at a cleaning station F. In various exemplary embodiments, the cleaning station F includes a preclean corona generator a rotatably mounted preclean brush 72 in contact with the photoconductive surface 12. The preclean corona generator neutralizes the charge attracting the particles to the photoconductive surface 12. These particles are cleaned from the photoconductive surface 12 by the rotation of the brush 72. One skilled in the art will appreciate that other cleaning means may be used, such as a blade cleaner. Subsequent to cleaning, a discharge lamp illuminates the photoconductive surface 12 to dissipate any residual charge remaining on the photoconductive surface 12 prior to the charging the photoconductive surface 12 for the next successive imaging cycle.

A control system coordinates the operation of the various components. In particular, a controller 30 responds to a sensor 32 and provides suitable actuator control signals to the corona generating device 28 the raster output scanner 36, and the development station C. The actuator control signals include state variables, such as charge voltage, developer bias voltage, exposure intensity and toner concentration. In various exemplary embodiments, the controller 30 includes an expert system 31. In various exemplary embodiments, the expert system 31 includes various logic routines to analyze sensed parameters in a systematic manner and reach conclusions on the state of the machine 1, and a combining circuit or application to perform functions disclosed herein such as, for example, combining sensed patch reflectivities. In various exemplary embodiments, the changes in output generated by the controller 30 are measured by a toner area coverage (TAC) sensor 32. The toner area coverage sensor 32, which is located downstream of development station C, measures the developed toner mass for difference area coverage patches recorded on the photoconductive surface 12. The manner of operation of one exemplary embodiment of a toner area coverage sensor 32, is described in U.S. Pat. No. 4,553,003, which is incorporated herein in its entirety. In various exemplary embodiments, the toner area coverage sensor 32 is an infrared reflectance type densitometer that measures the density of toner particles developed on the photoconductive the surface 12.

It should be understood that the term toner area coverage sensor or "densitometer" is intended to apply to any device for determining the density of print material on a surface, such as a visible-light densitometer, an infrared densitometer, an electrostatic voltmeter, or any other such device which makes a physical measurement from which the density of print material may be determined.

Before the toner area coverage sensor 32 can provide a meaningful response to the relative reflectance of patch, the toner area coverage sensor 32 must be calibrated by measuring the light reflected from a bare or clean area 200 of photoconductive belt surface 12 for a number of different toner concentrations.

As shown FIG. 1, the electrophotographic printing machine 1 also includes one or more of an electrostatic voltmeter (ESV) 33, a moisture/relative humidity sensor 34 and/or a temperature sensor 35. The electrostatic voltmeter 33 measures the voltage potential of control patches on the photoconductive surface 12 of the belt or drum 10. The moisture/relative humidity detector 34 and the temperature detector 35 are used to determine ambient relative humidity and temperature, factors which affect the reproduced toner image.

The systems and methods of this invention may be used to calibrate a xerographic systems toner concentration sensor to accurately control the sensor to a specified operating target. This may be accomplished, for example, by imaging using a raster output scanner, a light emitting diode array, or other photoreceptor sensitive calibrated light source, and developing a special set of 100% area coverage/continuous tone gray patches. The aforementioned 936 patent refers to these as solid area control patches. The toner patch images for toner control may be formed in an interimage area and may be formed as part of a different cycle or may be formed as part of the same cycle as the image formation. In other words, the toner patch images may be formed before and/or after normal image formation, and/or may be performed at the same time that is in the same cycle of forming an image.

According to the systems and methods of this invention, a charged photoreceptor 1 is exposed by the light source such as, for example, a raster output scanner or a light emitting diode bar, so that the image area achieves a predetermined exposure area potential forming a latent image. In other words, the light source is turned on and off based on the image signal from a controller so that a latent image corresponding to an image to be reproduced is formed.

A developing biasis then applied to the developing roll of the developing device, and when the latent image is passed through the developing roll, it is developed with toner and appears as a toner image. This toner image is transferred to a recording substrate, such as, for example, paper, and is forwarded to a fixing section where the resultant fixed image is outputted. The remaining toner on the photoreceptor 1 is removed and collected by a cleaner. Then, the photoreceptor charge is eliminated or erased uniformly by an erasing device for the next image forming cycle.

Figure 2:
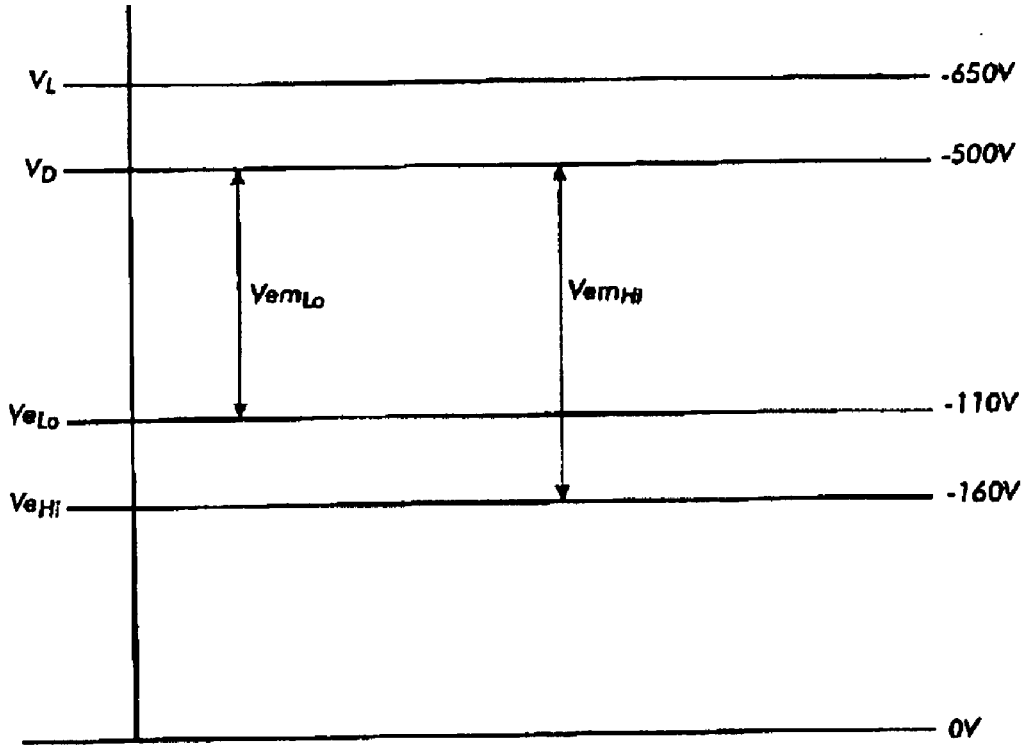
FIG. 2 illustrates various discharge potential levels on a photoreceptor in an image forming operation.

FIG. 2 illustrates exemplary potential levels on the photoreceptor during the formation of an image including, toner patch images. In FIG. 2, the photoreceptor 10 is initially charged at, for example, a −650 volts surface potential $V_L$. Then, the photoreceptor 10 is irradiated with light modulated by an image signal. The exposure area potential $V_e$ then becomes anywhere from −160 to −110 volts, for example. Then, a developing bias voltage of, for example, −500 volts is applied to the photoreceptor and toner, which is negatively charged, is attracted from the developing roll to the exposure area on the photoreceptor 1 in accordance with the voltage difference $V_{em}$ between the exposure area potential $V_E$ and the developing bias $V_D$. This voltage difference $V_{em}$ is also known as the contrast potential. The toner patch is formed and the image is formed with potential relationships similar to those mentioned above. $V_{em}$ represents the difference between the development voltage and the discharge voltage.

Figure 3:
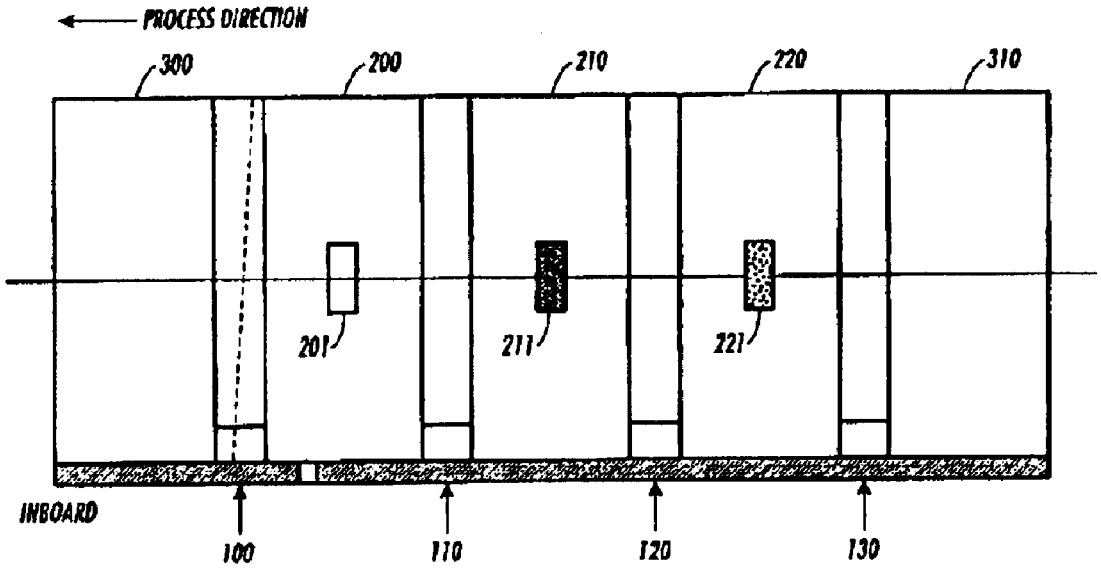
FIG. 3 illustrates one exemplary embodiment of a toner concentration calibration routine patch layout according to this invention.

FIG. 3 shows one exemplary embodiment of a toner concentration calibration return patch layout according to the systems and methods of this invention. In the exemplary embodiment shown in FIG. 3, the process direction moves from right to left. At the left side of the photoreceptor, a segment 300 is the last image area on the photoreceptor 10. The next segment 100 is the start of an inter-image area on the photoreceptor 10 and is the area on the photoreceptor 10 in which the photoreceptor bias level is zero, that is, there is no development taking place. The next inter-image area segment 200 is a bare photoreceptor segment. A densitometer, such as, for example, an infrared densitometer, is calibrated to obtain a 100% reflectivity reading. inter-image segment 200 is the segment of the photoreceptor where the light source is applied to achieve a bare photoreceptor patch 201, which is not developed.

Next is area 110, during which a development potential bias voltage is applied to the photoreceptor 10. In area 210, a light exposure is made to achieve a 100% area coverage contone gray patch 211 is formed. The exposure bias voltage is relatively low, resulting in a difference voltage between the applied development voltage and the exposure voltage of between, for example, −145 and −160 volts. $V_{em}$ is the difference between the development voltage $V_d$ and the discharge voltage $V_e$ due to the exposure light beam impinging on the photoreceptor. The $V_{em}$ value for the low $V_{emHi}$ patch would be approximately between 145 and 160 volts. In the next area, that is, area 120 of the photodetector, the developmental bias voltage is applied to the photoreceptor 10. Then, in area 220, a patch is exposed by light at a different bias bias voltage of, for example, between −105 and −120 volts. $V_{em}$ is the difference between the development voltage Vd and the discharge voltage $V_E$ due to the exposure light beam impinging on the photoreceptor. The $V_{em}$ value for the low $V_{emLo}$ patch would be approximately between 105 and 120 volts.

In the next area, segment 130, there is no development bias voltage applied. Then, in the next area, segment 310, the inter-image patch cycle beings to transition to the next routine, which may be to expose and develop a customer image, for example. The patch $V_e$ levels, that is, the discharge voltage levels are to be evaluated by electrostatic volt meter 33 to assure that the predetermined $V_{em}$ targets, for example, 120 and 160 volts are met. These gray patches are generated at the two different $V_{em}$ levels, one being $V_{em}$ high and the other being $V_{em}$ low. The resulting patches are then evaluated by a densitometer and the resulting readings are average to provide a measure of the toner concentration level. The $V_{em}$ target levels are selected to take advantage of a unique patch toner concentration response at opposite extremes of the desired measurement range.

As shown in FIG. 3, a lower $V_{em}$ patch reflectivity remains flat at low toner concentration levels and begins to break into a useful toner concentration response flow at the midrange of the overall measurement range. The higher $V_{em}$ patch, as shown in FIG. 3, responds with a useful relative reflectivity slope at low toner concentration levels and then begins to break into a flat saturated response at the midrange of the desired measurement range. By averaging the relative reflectivities of these two patches, a more linear toner control response is obtained, which provides an expanded toner concentration measurement range.

Figure 4:
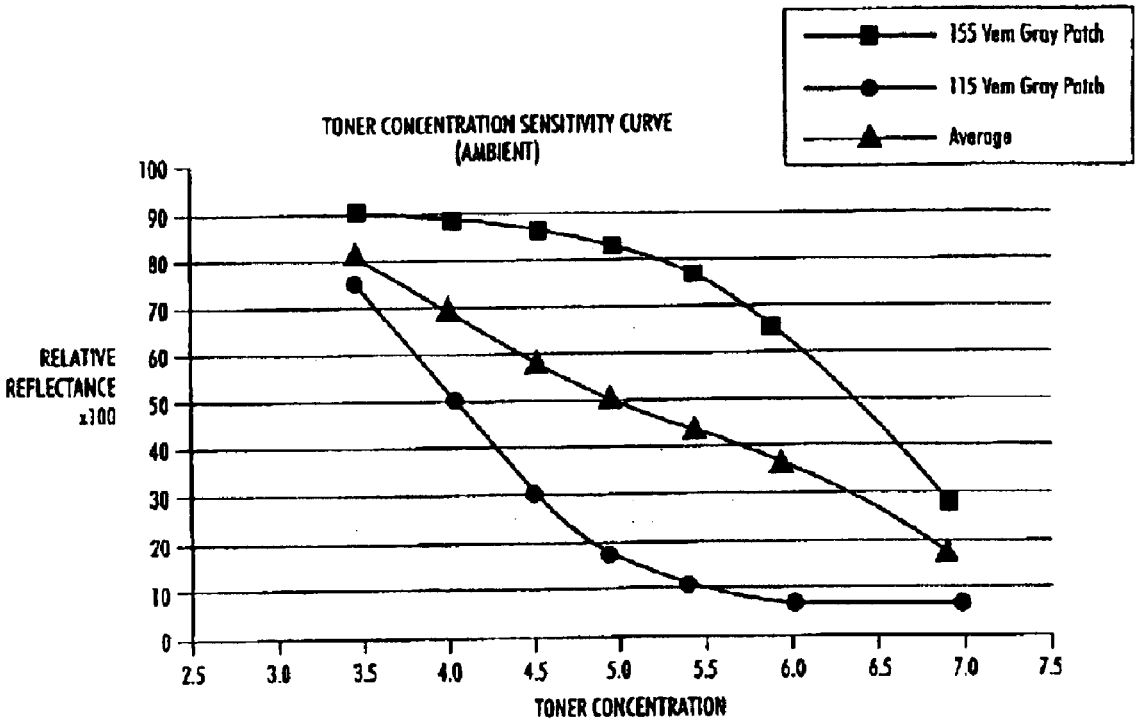
FIG. 4 shows toner concentration sensitivity curves plotting toner concentration against relative reflectance according to this invention.

FIG. 4 shows toner concentration sensitivity curves where toner concentration is plotted along the x-axis and relative reflectivity of a 100% area coverage developed toner patch on the photoreceptor 10 is plotted on the y-axis. These curves are formed by developing the calibration patches using different toner concentrations. In the exemplary embodiment of the calibration curves shown in FIG. 4, for example, the toner concentration was varied from approximately 3.5 to approximately 7, where toner concentration T/D is defined as the ratio of the weight of toner in grams divided by the weight of the overall developing agent. The top curve illustrates toner concentration versus relative reflectivity of the Hi $V_{em}$ patch. In the specific exemplary embodiment illustrated in FIG. 4, the top calibration curve was formed at a difference voltage $V_{em}$ of approximately 155 volts. The bottom curve illustrates toner concentration versus relative reflectivity of the Lo $V_e$, patch. In the specific exemplary embodiment illustrated in FIG. 4, the bottom calibration curve was formed at a difference voltage $V_{em}$ of approximately 115 volts. The middle calibration curve illustrates the average of the top and bottom calibration curves. The top calibration curve tends to saturate below a toner concentration of about 5. The bottom calibration curve tends to saturate above a toner concentration of about 5. However, the middle calibration curve, i.e., the average calibration curve, appears to have a good slope throughout the entire toner concentration range between about 3.5 to 7. Thus, the middle calibration curve provides a predictable and substantially linear relationship between the average relative reflectivity of the two toner patches, and toner concentration. This results in improved toner concentration control. It should be noted that, in FIG. 4, seven different values of toner concentration are used to determine each of the top and bottom calibration curves.

Figure 5:
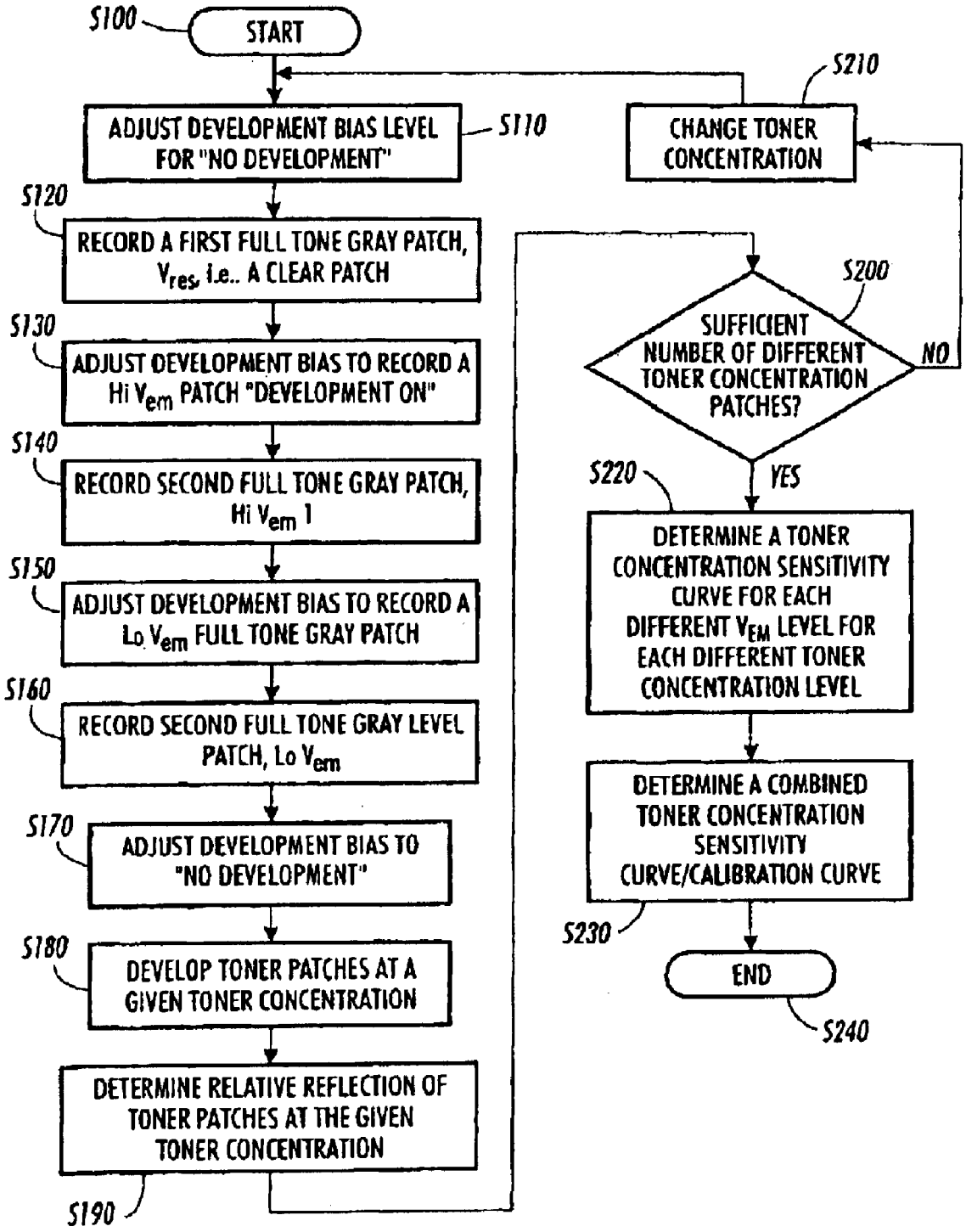
FIG. 5 is a flowchart illustrating one exemplary embodiment of a method for calibrating a toner concentration sensor according to the invention.

FIG. 5 is a flowchart illustrating one exemplary embodiment of a method for determining a toner concentration sensor calibration curve according to this invention. As shown in FIG. 5, the method starts in step S100, and proceeds to step S110, where the development bias is adjusted to "no development." Then, in step S120, a first patch, a clear patch, which is not developed, is imaged onto the photoreceptor. This patch is the 100% reflective patch used to calibrate the toner concentration sensor that is being calibrated. Then, in step S130, the development bias is turned on and adjusted to be able to develop/record a relatively higher $V_{em}$ patch on the photoreceptor. Control then proceeds to step S140.

In step S140, a 100% area coverage gray contone patch, with the relatively higher $V_{em}$ is imaged onto the photoreceptor. Next, in step S150, the development voltage adjusted to apply a development voltage to the photoreceptor 10 to be able to develop/record a relatively lower $V_{em}$ patch. Then, in step S160, a 100% area coverage gray level patch is exposed on the photoreceptor with the relatively lower $V_{em}$. Control then proceeds to step S170.

In step S170, the development bias is adjusted to "no development." Then, in step S180, the toner patches are developed at a given toner concentration. Next in, step S190, the relative reflections of the developed toner patches developed at the given toner concentration are obtained. Operation then proceeds to step S200.

In step S200, a determination is made whether there is a sufficient number of toner patches developed at a sufficient number of different toner concentrations to determine the desired number of base toner concentration sensitivity curves. If not, control proceeds to step S210, where the toner concentration of the print engine is changed to a different value than that previously used. Control then jumps back to step S110.

Otherwise, if a sufficient number of toner patches have been developed and sensed, control proceeds to step S220. In step S220, for each different $V_{em}$ level, a calibration curve is determined from the toner patches developed at that voltage level for each of the different toner concentration levels. Then, in step S230, a combined calibration curve is determined from at least some of the plurality of distinct calibration curves. Next, in step S240, the operation of the method ends.

Based on a combined calibration curve obtained as described above, the controller 30 may vary parameters, such as toner concentration, the development voltage, a jumping AC voltage, If used, and may make similar adjustments based upon ambient temperature and relative humidity conditions, among other factors, to improve the output of the electrophotographic printing machine 1. The incorporated 153 patent discloses systems and methods for such process control of, the electrophotographic printing machine 1.

This technique provides sensitivity over a wider range of toner concentration than do previous devices, providing a more accurate indication of how far away the system is from a controlled toner concentration target range. This system utilizes an electrostatic volt meter (ESV) 33 and an infrared densitometer (IRD) 34, as well as, optionally, a moisture/relative humidity sensor 34 and a temperature sensor 35.

Because charge area potential is affected somewhat by the environment, and the individual differences between photoreceptors, the developer charge amount varies with changes in humidity and with degradation of the developer. For example. As developer material sits idle for a long period of time, for example, 24 hours or more, the charge between the developer material particles, i.e., toner and carrier particles, becomes weak. This weakness is aggravated even more when the humidity increases. The net effect is that the initial copies become darker than expected, resulting in relatively poor copy quality. As a result, the systems and methods according to this invention also provide for sensing temperature and relative humidity in using these factors to help control the toner concentration.

The systems and methods according to this invention achieve wide component latitude and the ability to maintain high image quality for printing systems. In particular, the systems and methods of this invention calibrate a toner concentration sensor by operating it at two extreme development voltage levels where the sensors provide the most sensitive data.

The systems and methods according to this invention may be used to achieve both image quality setup and post run-mode cycle-out evaluation of toner concentration control of a xerographic printing machine.

While there have been illustrated and described what are at present considered to be exemplary embodiments of the present invention, it will be appreciated that numerous changes and modifications are likely to occur to those skilled in the art, and it is intended to cover in the appended claims all of those changes and modifications which fall within the true spirit and scope of the present invention.

What is claimed is:

1. A method of calibrating a toner concentration sensor for a print engine having an exposure discharge voltage and a development voltage, comprising:

imaging a first patch on a photoreceptor at a particular relatively large difference voltage between an exposure discharge voltage and a development voltage;

imaging a second patch at a relatively smaller voltage difference between an exposure discharge voltage and a development voltage which is relatively small;

developing first and second patches at a first toner concentration;

repeating the imaging steps and developing the resulting first and second imaged patches at toner concentrations different from the first toner concentration;

determining the relative reflectance values of both the developed first patches and the second patches at the different toner concentrations; and combining, for each toner concentration value the relative reflectance values for the first and second patches to provide an average toner concentration sensitivity for the print engine.

2. The method according to claim 1 further including sensing ambient temperature and relative humidity in the area of the print engine.

3. The method of claim 1, further including adjusting the print engine in accordance with the average toner concentration sensitivity.

4. The method of claim 3, wherein the method of adjusting the print engine includes adjusting development voltage.

5. The method of claim 3, wherein the method of adjusting the print engine includes adjusting toner concentration.

6. The method of claim 1, wherein the patches are continuous tone gray patches.

7. A system for calibrating a toner concentration sensor for a print engine having an exposure discharge voltage and a development voltage, comprising:

an imager that images at least a first continuous tone gray patch on a photoreceptor at a relatively larger difference voltage between an exposure discharge voltage and a development voltage; and a second patch at a relatively smaller voltage difference between the exposure discharge voltage and a development voltage;

a developing device that develops the at least first and second patches at a predetermined toner concentration;

a sensor that senses a reflectivity of the at least first and second patches;

a combining circuit or application that combines the sensed reflectivities of the at least first and second patches to determine a combine reflectivity for the determined toner concentration;

wherein the determined toner concentration is varied over a range of toner concentrations, the at least first and second patches are repeatedly imaged and developed at a plurality of different toner concentrations over the range of toner concentrations, the sensor senses the reflectances for the first and second patches for the plurality of different toner concentrations, and the combining circuit determines the reflectivity for the plurality of different toner concentrations.

8. The system according to claim 7, further comprising at least one of at least one ambient temperature sensor and at least one relative humidity sensor.

* * * * *